US012096892B2

(12) United States Patent
Gui

(10) Patent No.: US 12,096,892 B2
(45) Date of Patent: Sep. 24, 2024

(54) FOAM PUMP

(71) Applicant: Shenzhen City Itas in-tech Sanitary Wares Co., Limited, Shenzhen (CN)

(72) Inventor: Yingcai Gui, Shenzhen (CN)

(73) Assignee: Shenzhen City Itas in-tech Sanitary Wares Co., Limited

( * ) Notice: Subject to any disclaimer, the term of this patent is extended or adjusted under 35 U.S.C. 154(b) by 73 days.

(21) Appl. No.: 18/098,251

(22) Filed: Jan. 18, 2023

(65) Prior Publication Data

US 2023/0148802 A1 May 18, 2023

(51) Int. Cl.
*A47K 5/14* (2006.01)
*A47K 5/12* (2006.01)

(52) U.S. Cl.
CPC ..... *A47K 5/14* (2013.01); *A47K 5/1217* (2013.01)

(58) Field of Classification Search
CPC ..... A47K 5/14; A47K 5/1217
See application file for complete search history.

(56) References Cited

U.S. PATENT DOCUMENTS 5,823,390 A * 10/1998 Muderlak ..... A47K 5/1217 222/642
2004/0226962 A1* 11/2004 Mazursky ..... A47K 5/1217 222/64
2007/0119873 A1* 5/2007 Boll ..... B05B 11/1057 222/333
2012/0217267 A1 8/2012 Bunoz et al.
2013/0315031 A1 11/2013 Bunoz et al.
2015/0320266 A1 11/2015 Creaghan et al.
2021/0378459 A1* 12/2021 Yang ..... A47K 5/1211
2022/0095851 A1* 3/2022 Romanyszyn ..... A47K 5/1217
2023/0148802 A1* 5/2023 Gui ..... A47K 5/1217 222/190

FOREIGN PATENT DOCUMENTS

CA 3207398 A1 * 8/2022 ..... A47K 5/1209
CN 213758008 U * 7/2021
CN 113208475 A * 8/2021
DE 202014003115 U1 * 8/2015 ..... A47G 19/183
KR 100878601 B1 * 1/2009

* cited by examiner

*Primary Examiner* — Bob Zadeh
(74) *Attorney, Agent, or Firm* — Jose Cherson Weissbrot

(57) ABSTRACT

A novel foam pump is provided, including a shell main body and a nozzle; a battery and a foam pump body are arranged in the shell main body; the nozzle is provided with a circuit board and a foam outlet; the circuit board is electrically connected with the battery and the foam pump body; the circuit board is electrically connected with a trigger switch; a fixed support is arranged inside the shell main body; the fixed support has an upper mounting position and a lower mounting position; the foam pump body is mounted at the upper mounting position; the battery is arranged at the lower mounting position; the fixed support is provided with a positioning clamping slot; and the shell main body is provided with a positioning clamp bulge.

8 Claims, 10 Drawing Sheets

FOAM PUMP

TECHNICAL FIELD

The present disclosure relates to a foam pump.

BACKGROUND

The statements here only provide the background information related to the present disclosure, and do not necessarily constitute the prior art.

With the improvement of the living standard, people are also pursuing the convenience of daily necessities. For example, for bottled liquid, a liquid pump is usually mounted at an outlet of a bottle body, and the liquid in the bottle body can flow out by pressing the pump.

The bottled liquid is in a liquid state when used, such as a liquid detergent. However, some liquids still need to be kneaded into foam during use, such as disinfectant. Traditionally, the liquid is pumped out by pressing a pump body and is then rubbed on the hands to form foam, which is more troublesome.

Later, there is a foam pump. The foam pump makes hand-washing foam from hand sanitizer through motor mixing and other structures, and the hand-washing foam is directly pumped out from an outlet of a bottle body for use. However, the existing foam pump still has an unreasonable structural design. As a result, when the bottle body falls off, a battery, a pump body and other structures easy to loosen and fail to work. Meanwhile, there is also a problem of difficulty in assembling.

Therefore, it is necessary to study a new technical solution to solve the above problems.

SUMMARY

In order to solve the defects and shortcomings in the prior art, the present disclosure provides a novel foam pump. A battery and a foam pump body are mounted on a fixed support, and the fixed support is then mounted in a shell main body; and mounting and fixing are completed by means of cooperation between a positioning clamping slot and a positioning clamping bulge. The novel foam pump has the advantages of simple assembling and high assembling stability. Thus, when the novel foam pump falls off, the position stability of the foam pump body and the battery can also be guaranteed.

In order to achieve the above-mentioned objective, the present disclosure adopts the following technical solution:

A novel foam pump includes a shell main body and a nozzle arranged on an upper side of the shell main body; a battery and a foam pump body are arranged in the shell main body; the nozzle is provided with a circuit board and a foam outlet; the circuit board is electrically connected to the battery and the foam pump body; the foam pump body is provided with an input end and an output end; the input end of the foam pump body is connected with a suction pump; the suction pipe extends out of the shell main body; the output end of the foam pump body is connected with the foam outlet; and the circuit board is electrically connected with a trigger switch.

A fixed support is arranged inside the shell main body; the fixed support has an upper mounting position and a lower mounting position; the foam pump body is mounted at the upper mounting position; the battery is arranged at the lower mounting position; a circumferential surface of the fixed support is provided with a positioning clamping slot; and the shell main body is provided with a positioning clamp bulge matched with the positioning clamping slot.

In some embodiments, a first placement place is arranged on a circumferential side of the lower mounting position; a second placement place is arranged on an upper side of the upper mounting position; and a buffer space is reserved between the upper mounting position and the lower mounting position.

In some embodiments, a gap is arranged on a circumferential side wall of the upper mounting position.

In some embodiments, the trigger switch includes a touch switch and a trigger sensor which are arranged on the circuit board; the touch switch is arranged on an upper side surface of the nozzle; the trigger sensor is arranged on a lower side surface of the nozzle; and a sensing region of the trigger sensor is correspondingly arranged below the foam outlet.

In some embodiments, the trigger sensor is an infrared sensor.

In some embodiments, a connecting cap connected with a bottle body is detachably arranged below the nozzle; and a connecting slot connected with a pourer is formed between the connecting cap and the shell main body.

In some embodiments, a pressing spacer is arranged in the connecting cap.

In some embodiments, the nozzle includes an upper cover and a lower cover; the lower cover upwards extends to form an elastic fastener; the upper cover is provided with a fastening hole matched with the elastic fastener; and the upper cover and the lower cover are assembled to form a mounting cavity for mounting the circuit board.

Compared with the prior art, the present disclosure has outstanding advantages and beneficial effects. Specifically, it can be known according to the above technical solution that the battery and the foam pump body are mainly mounted on the fixed support, and the fixed support is then mounted in the shell main body. Mounting and fixing are completed by means of the cooperation between the positioning clamping slot and the positioning clamping bulge. The novel foam pump has the advantages of simple assembling and high assembling stability. Thus, when the novel foam pump falls off, the position stability of the foam pump body and the battery can also be ensured. Meanwhile, there is a buffer space reserved between the foam pump body and the battery, so that the impact of the work of the foam pump body on the service life, the safety and other properties of the battery can also be effectively reduced.

In order to describe the structural features and effects of the present disclosure more clearly, the present disclosure is described in detail below in combination with the accompanying drawings and specific embodiments.

REFERENCE NUMERALS IN THE DRAWINGS

10: shell main body; 20: nozzle; 201: upper cover; 2011: clamping hole; 202; lower cover; 2021: elastic fastener; 21: circuit board; 211: touch switch; 212: trigger sensor; 22: foam outlet; 23: mounting cavity; 30: battery; 40: foam pump; 50: suction pipe; 60: fixed support; 61: upper mounting position; 611: gap; 62: lower mounting position; 621: first placement place; 63: positioning clamping slot; 64: buffer space; 70: connecting cap; 71: connecting slot; and 72: pressing spacer.

DETAILED DESCRIPTION OF THE EMBODIMENTS

The technical solutions in the embodiments of the present disclosure will be clearly and completely described below in conjunction with the accompanying drawings. Apparently, the described embodiments are only preferred embodiments of the present disclosure.

It should be noted that when an element is referred to as being "fixed" to another element, it can be directly on the other element or an intermediate element may also exist. When one element is considered to be "connected" to another element, it can be directly connected to another element or there may be a central element at the same time. The terms "perpendicular", "horizontal", "left", "right" and similar expressions used herein are for illustrative purposes only, and are not meant to be the only implementation modes.

Unless otherwise defined, all technical and scientific terms used herein are the same as meanings of general understandings of those skilled in the art of the present disclosure. The terms used in the description of the present disclosure herein are merely to describe the specific implementation modes, not intended to limit the present disclosure. The term "and/or" used herein includes any and all combinations of one or more related listed items.

Figure 1:
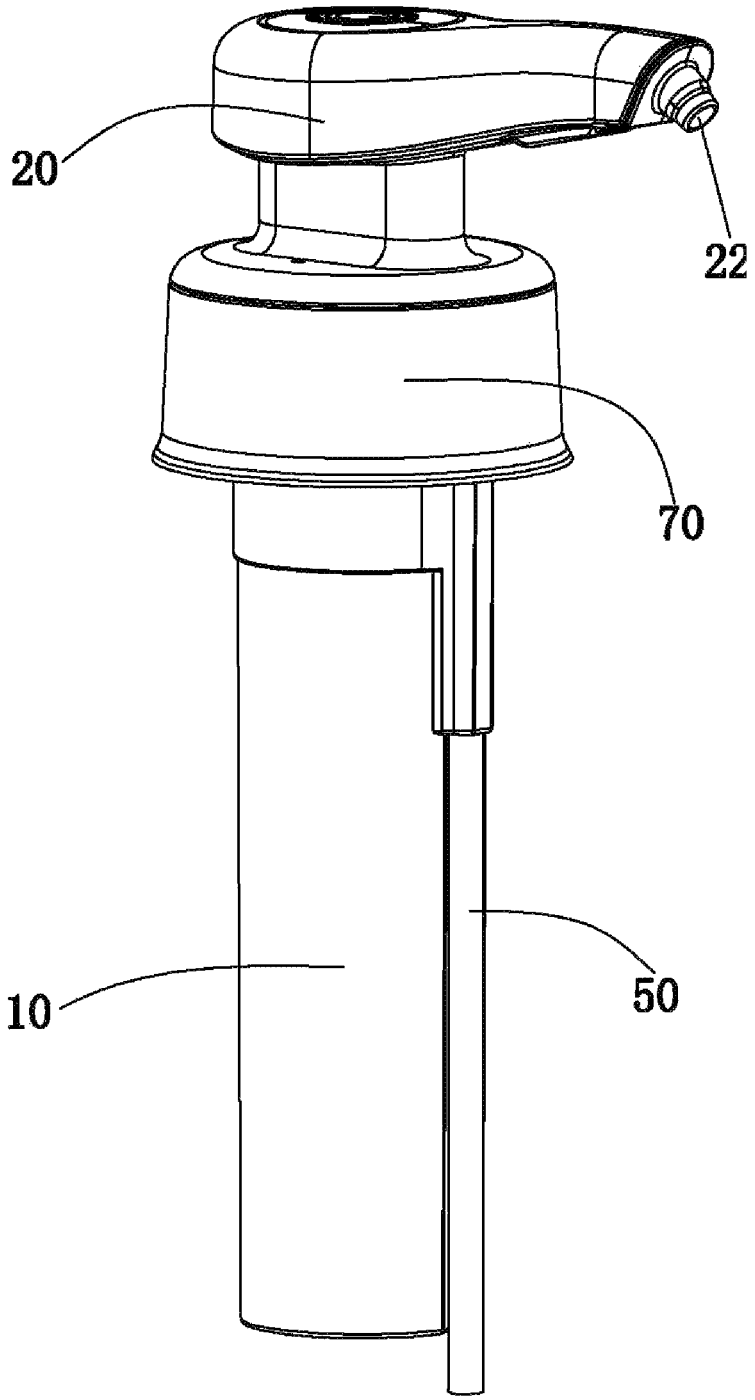
FIG. 1 is a schematic three-dimensional diagram of Embodiment I of the present disclosure.
Figure 2:
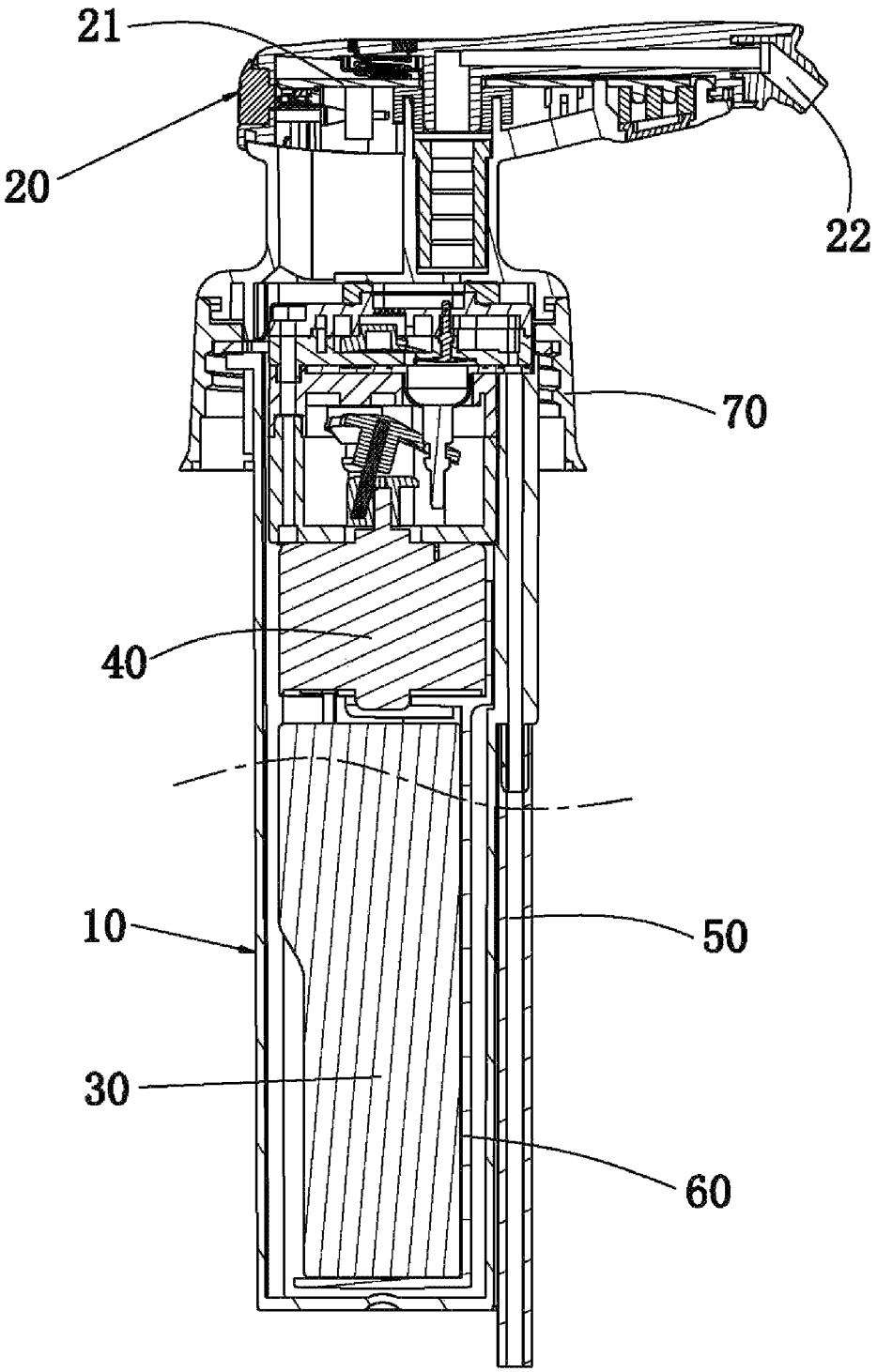
FIG. 2 is a schematic sectional diagram of Embodiment I of the present disclosure.
Figure 3:
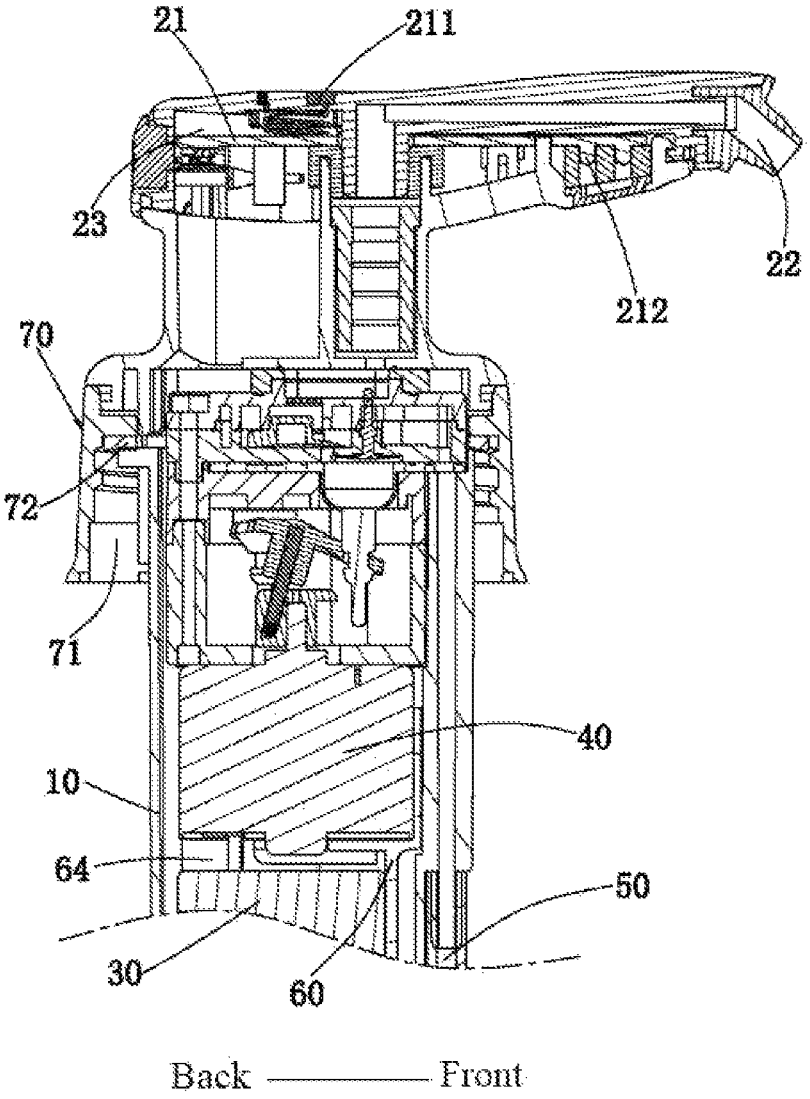
FIG. 3 is a partially enlarged diagram of FIG. 2.
Figure 4:
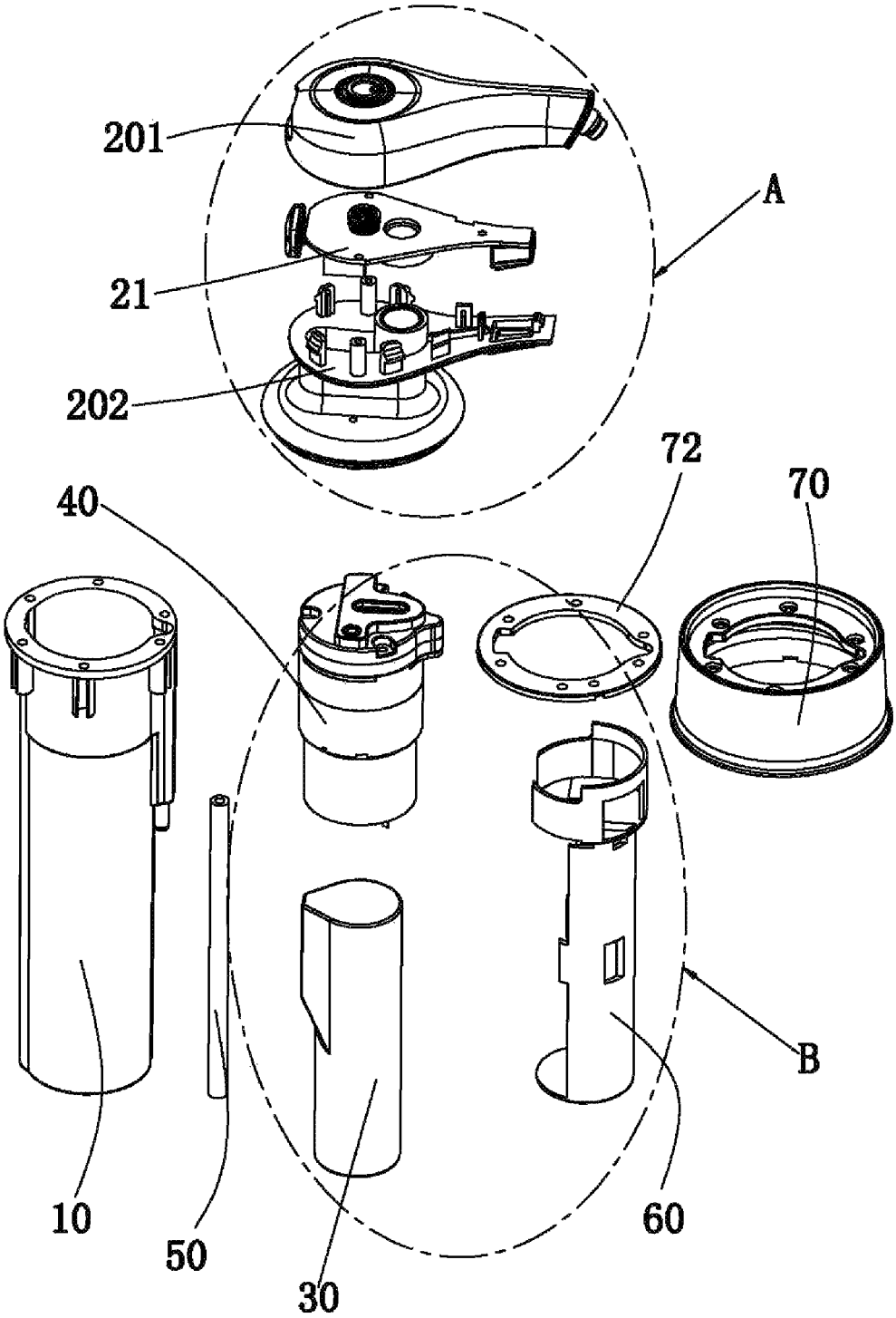
FIG. 4 is an exploded diagram of Embodiment I of the present disclosure.
Figure 5:
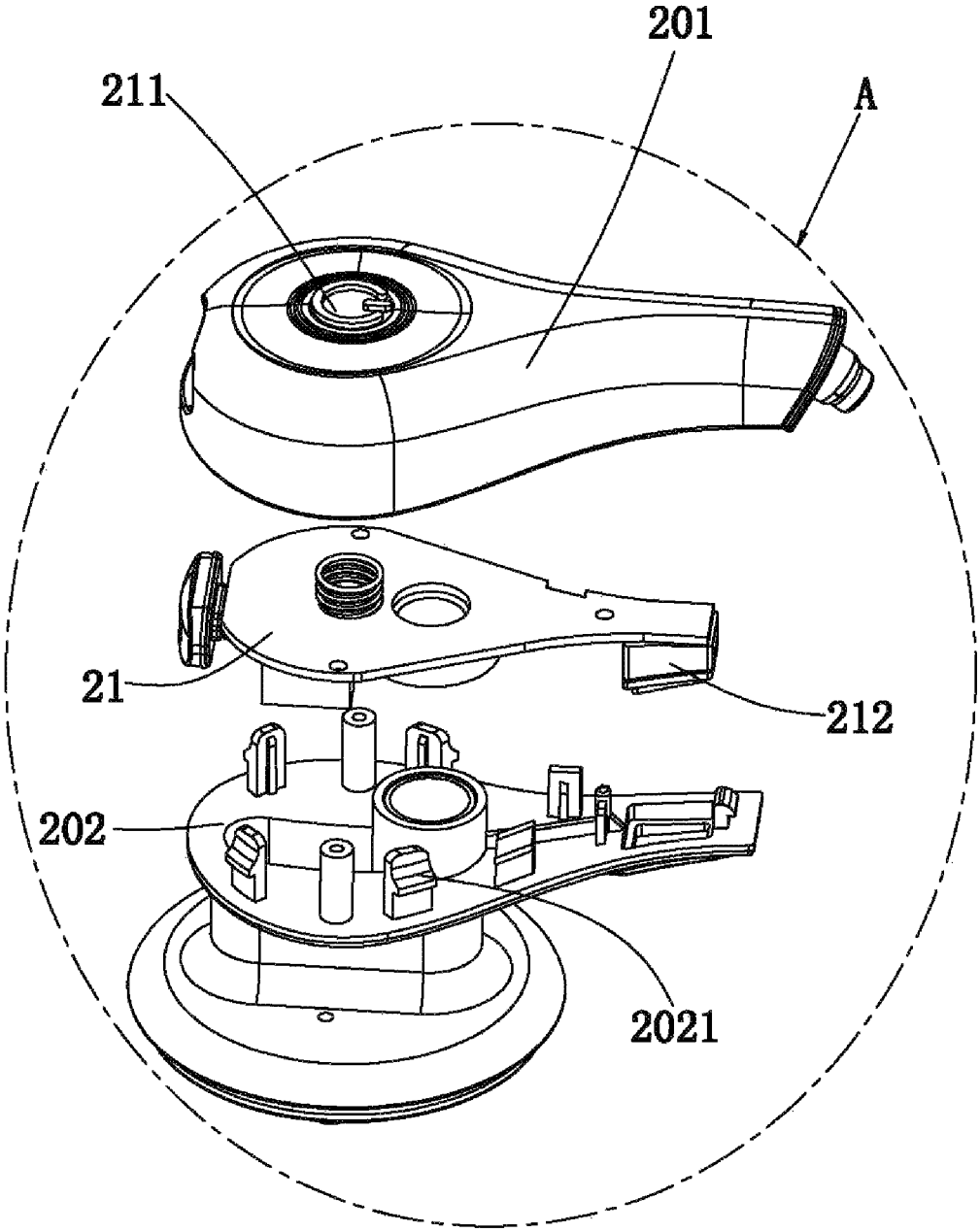
FIG. 5 is a schematic enlarged diagram of the part A in FIG. 4.
Figure 6:
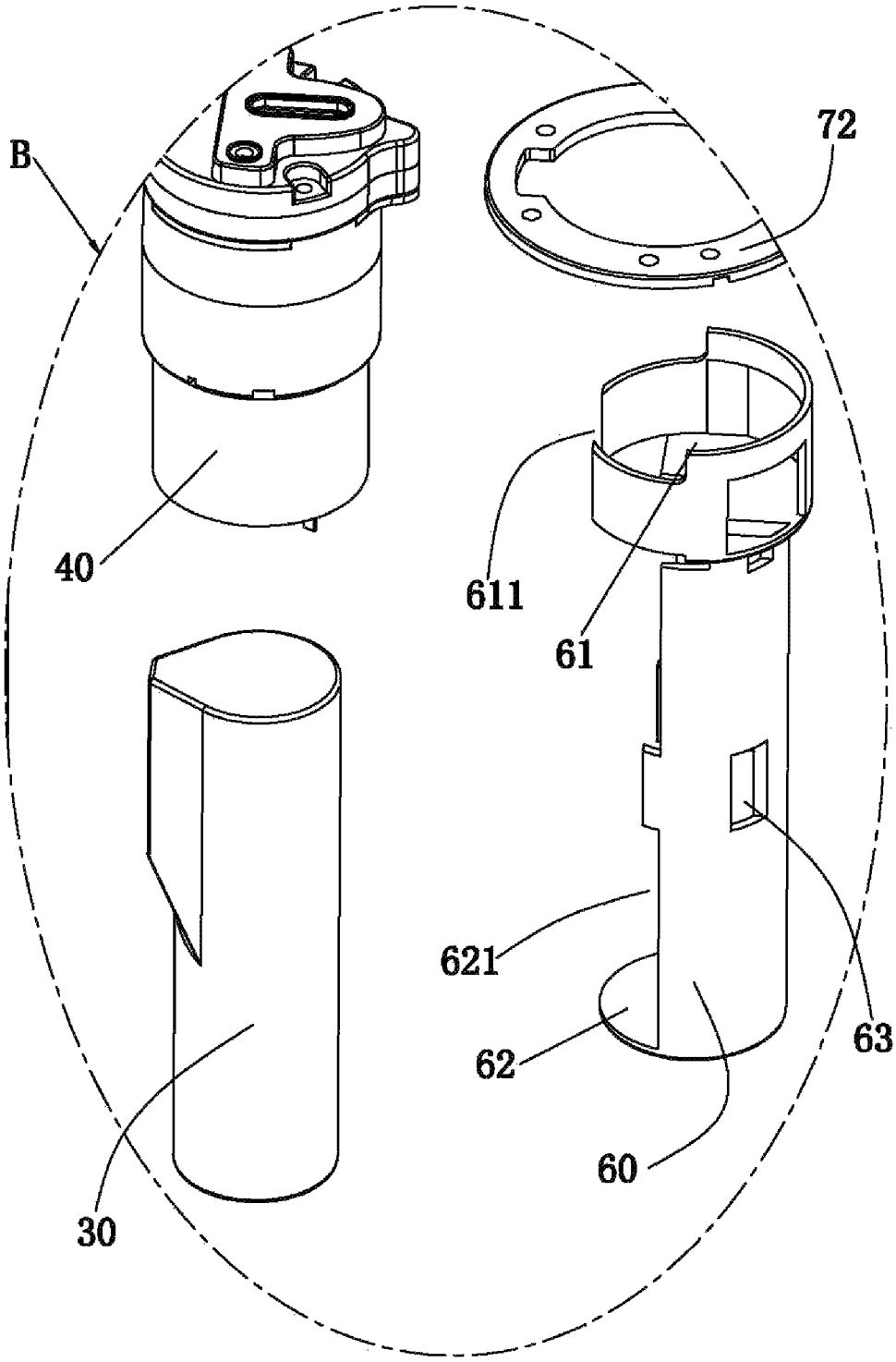
FIG. 6 is a schematic enlarged diagram of the part B in FIG. 4.
Figure 7:
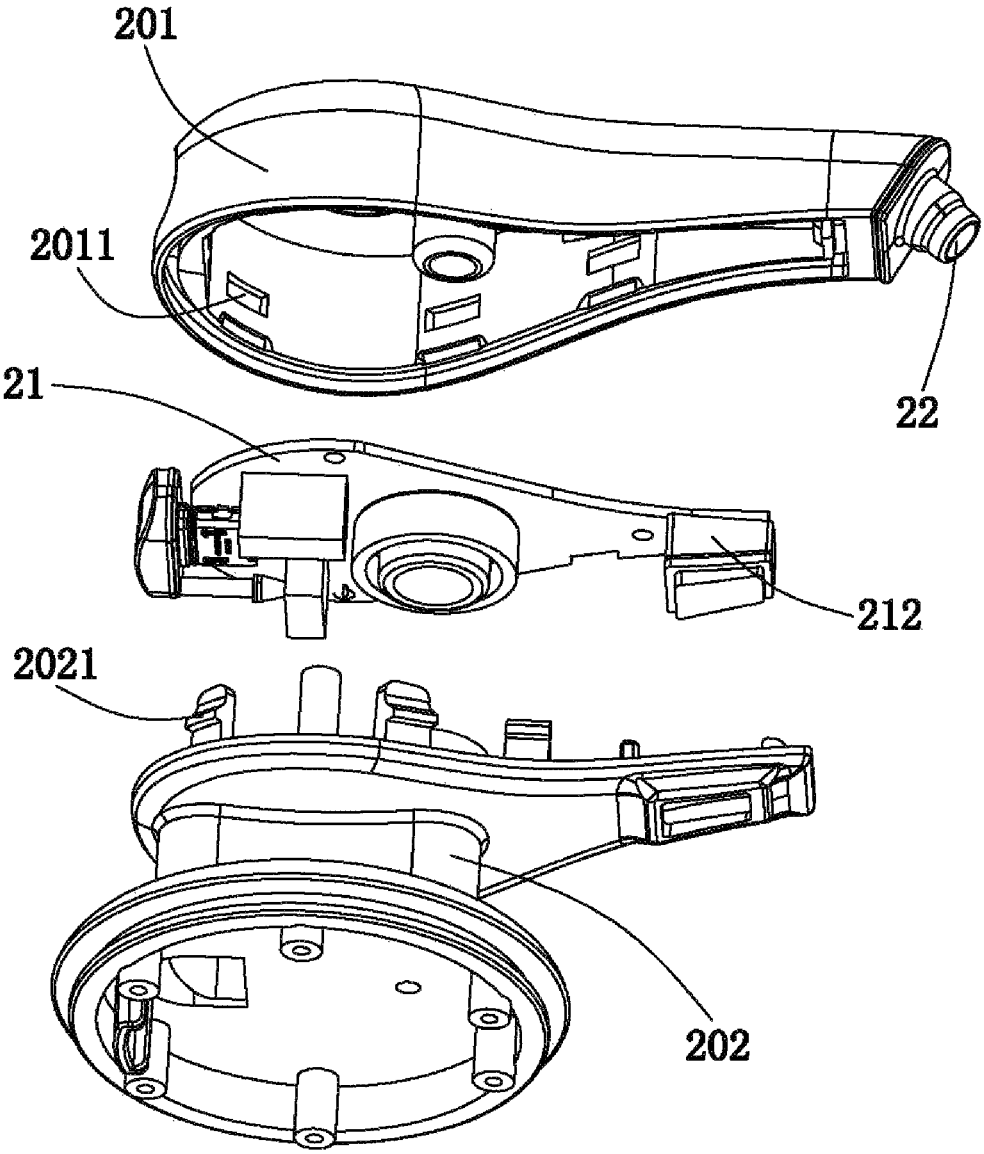
FIG. 7 is a schematic exploded diagram of a nozzle in Embodiment I of the present disclosure.
Figure 8:
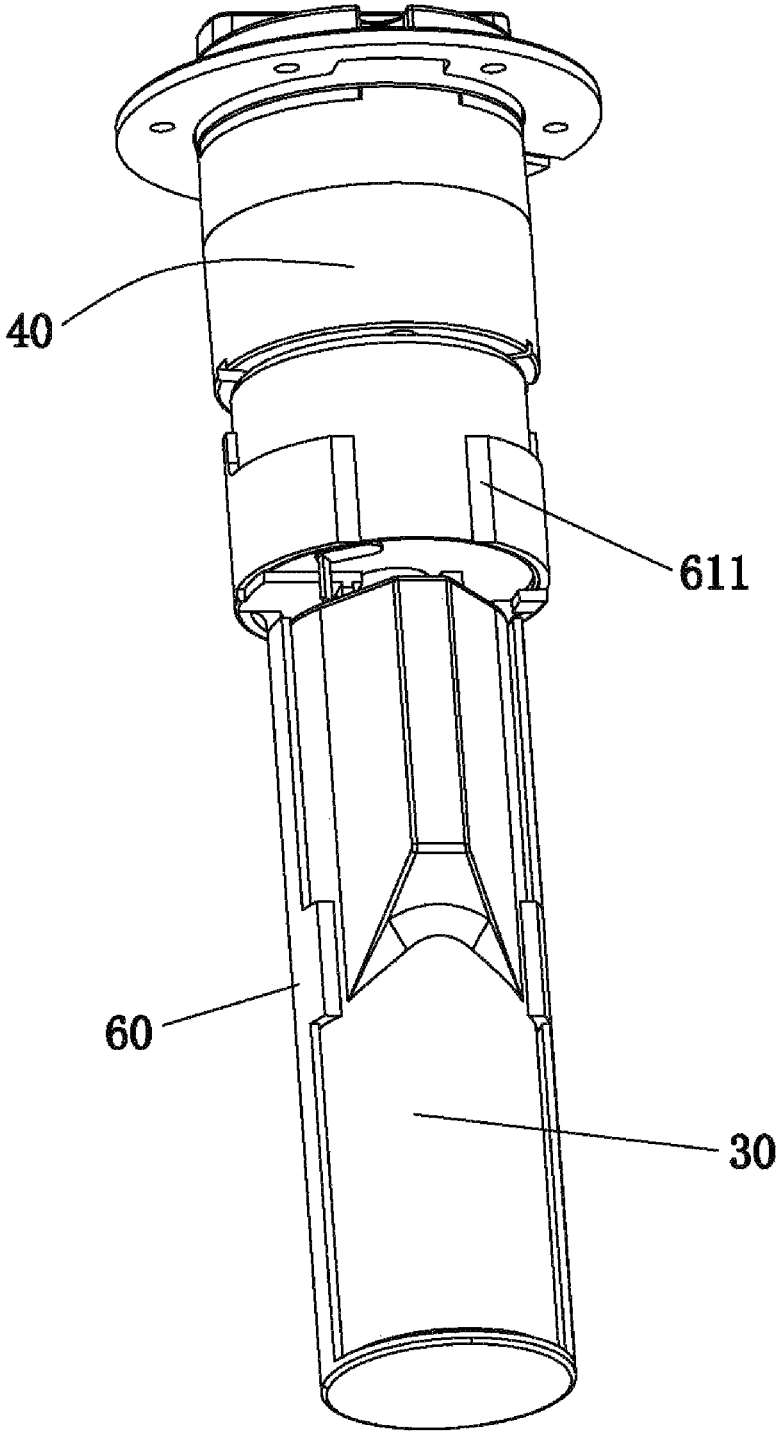
FIG. 8 is a schematic three-dimensional diagram of a support module in Embodiment I of the present disclosure.
Figure 9:
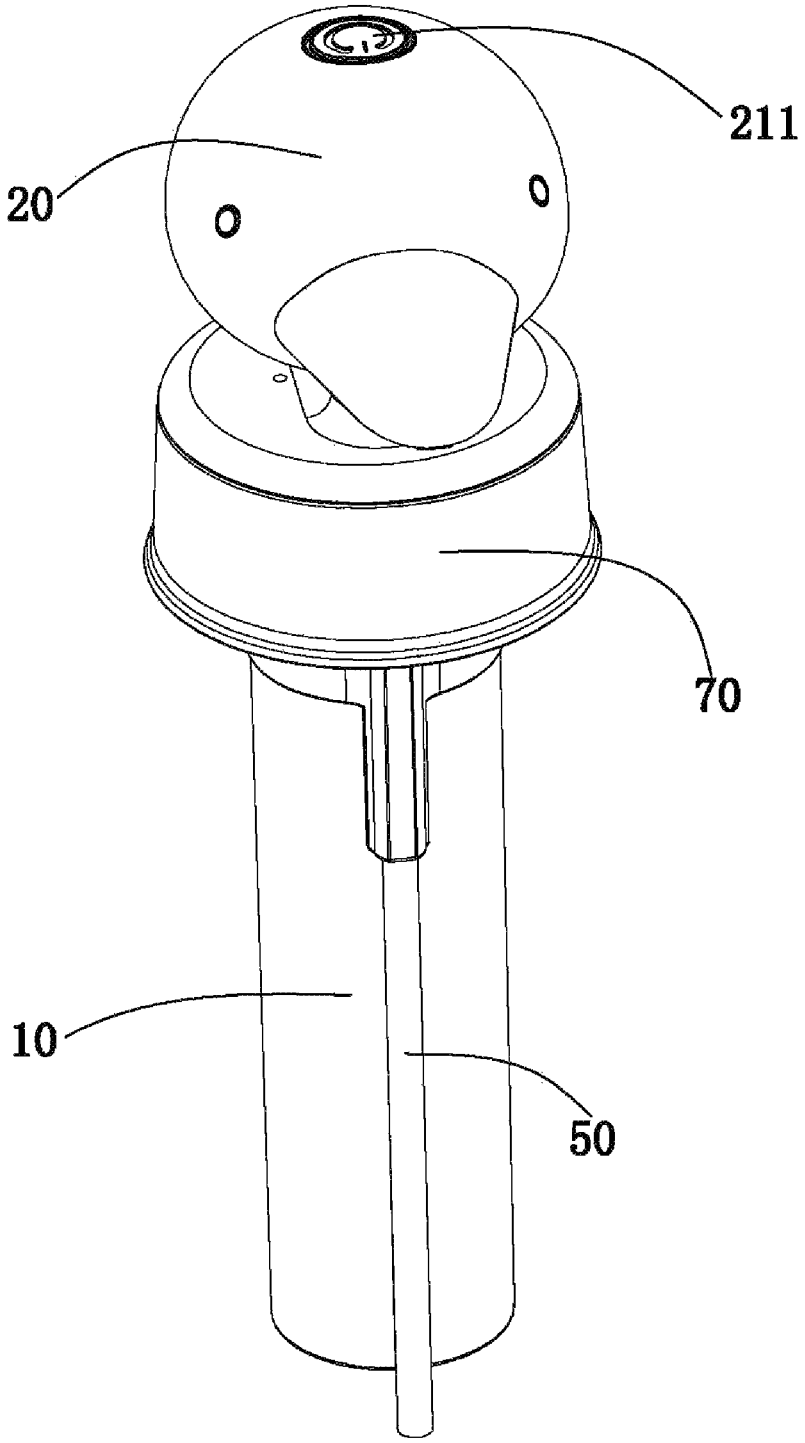
FIG. 9 is a schematic three-dimensional diagram of Embodiment II of the present disclosure.
Figure 10:
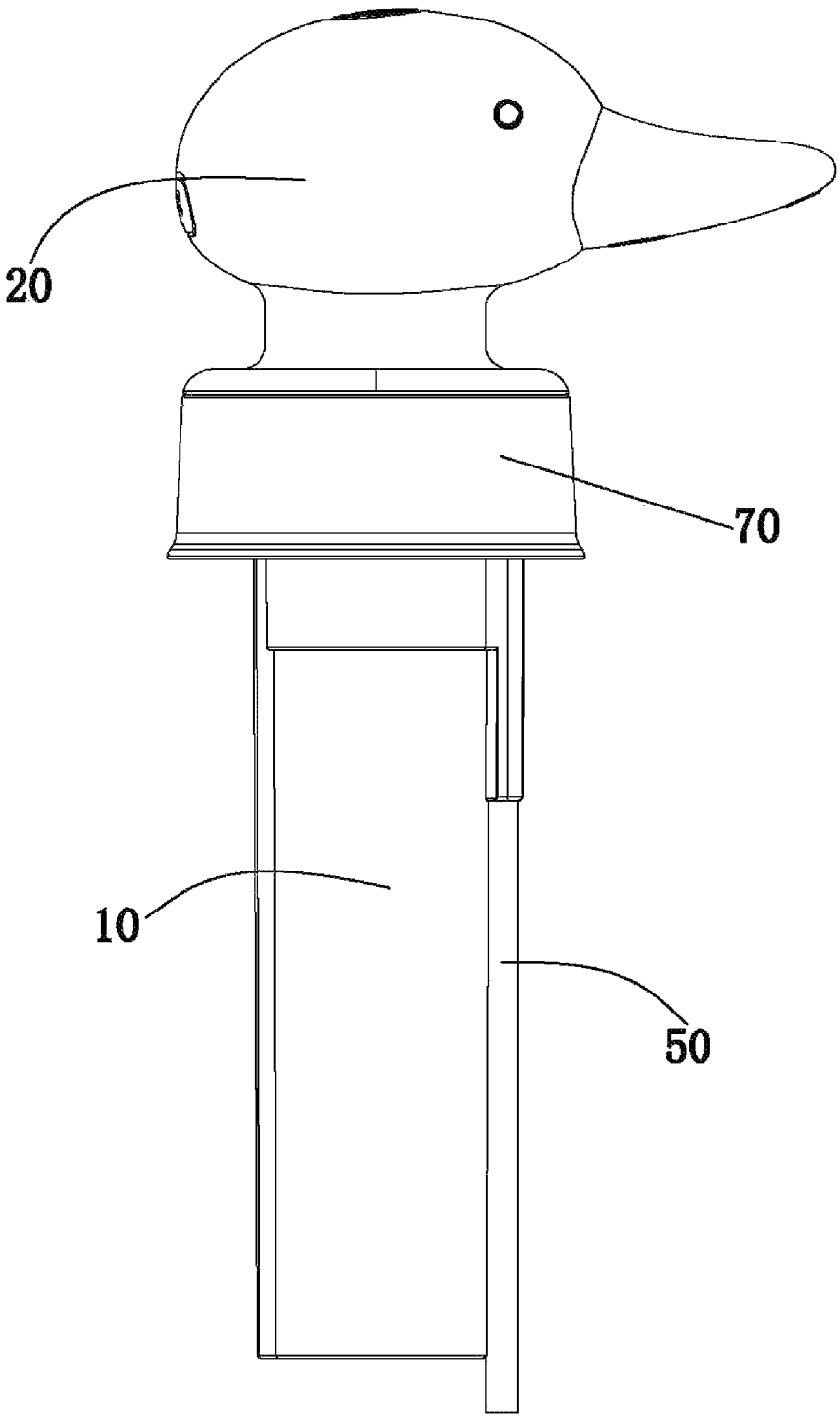
FIG. 10 is a side view of Embodiment II of the present disclosure.

Referring to FIG. 1 to FIG. 10, a novel foam pump in an embodiment of the present disclosure includes a shell main body 10 and a nozzle 20 arranged on an upper side of the shell main body 10. A battery 30 and a foam pump body 40 are arranged in the shell main body 10. The nozzle 20 is provided with a circuit board 21 and a foam outlet 22. The circuit board 21 is electrically connected to the battery 30 and the foam pump body 40. The foam pump body 40 is provided with an input end and an output end. The input end of the foam pump body 40 is connected with a suction pump 50. The suction pipe 50 extends out of the shell main body 10. The output end of the foam pump body 40 is connected with the foam outlet 22. The circuit board 21 is electrically connected with a trigger switch.

The shell main body is cylindrical, which extends vertically. A fixed support 60 is arranged inside the shell main body 10. The fixed support 60 has an upper mounting position 61 and a lower mounting position 62. The foam pump body 40 is mounted at the upper mounting position 61. The battery 30 is arranged at the lower mounting position 62. A circumferential surface of the fixed support 60 is provided with a positioning clamping slot 63. The shell main body 10 is internally provided with a positioning clamp bulge matched with the positioning clamping slot 63.

During assembling, the battery 30 and the foam pump 40 are first fixedly mounted on the support 60 to form a support module. The entire support module is then arranged in the shell main body 10 (specifically, an accommodating cavity is formed in the shell main body, and the accommodating cavity has an upper-end opening; and the support module is arranged in the shell main body from the upper-end opening of the shell main body).

Specifically, a first placement place 621 is arranged on a circumferential side of the lower mounting position 62, and a second placement place is arranged on an upper side of the upper mounting position 61. During assembling, the battery 30 is arranged in the lower mounting position 62 from the first placement place 621. Furthermore, the circumferential side wall of the lower mounting position 62 achieves a clamping and fixing effect on the battery 30. The foam pump body 40 is arranged in the upper mounting position 61 from the second placement place. In addition, a gap 611 is formed in a circumferential side wall of the upper mounting position 61. Thus, when the foam pump body 40 is arranged at the upper mounting position 61, the circumferential side wall of the second mounting position achieves a clamping and fixing effect on the foam pump body 40 (specifically, the gap is formed in the circumferential side wall, so that the circumferential side wall of the mounting position acts as a clamping wall, which has a clamping and fixing function). In addition, a buffer space 64 is reserved between the upper mounting position 61 and the lower mounting position 62, so that when the foam pump body 40 works (vibrates), the impact on the battery 30 can be reduced, which can avoid damages to the battery 30.

Further, the trigger switch includes a touch switch 211 and a trigger sensor 212 which are arranged on the circuit board 21. The touch switch 211 is arranged on an upper side surface of the nozzle 20. The trigger sensor 212 is arranged on a lower side surface of the nozzle 20. A sensing region of the trigger sensor 212 is correspondingly arranged below the foam outlet 22. Thus, the foam pump body 40 can work and discharge foam when a user touches it with a hand or by means of contactless induction, and the user can wash hands with the foam. Usually, the trigger sensor 212 is an infrared sensor.

Further, a connecting cap 70 connected with a bottle body is detachably arranged below the nozzle 20. The connecting cap 70 is generally connected with a pourer of the bottle body. Specifically, a connecting slot 71 connected with the pourer is formed between the connecting cap 70 and the shell main body 10. A connecting thread, such as an internal thread, is arranged in the connecting slot 71, and the pourer is usually provided with an external thread matched with the internal thread. Preferably, a pressing spacer 72 (a seal spacer) is arranged in the connecting cap 70, so that when the foam pump body 40 is connected with the bottle body, the airtightness can be ensured.

In actual applications, the connecting cap 70 can be of different specifications, so as to adapt to various bottle bodies. During working, the foam pump body 40 works, and the suction pipe 50 inputs hand sanitizer from the bottle body into the foam pump, and the foam pump stirs the hand sanitizer to form foam and discharges the foam from the foam outlet 22 of the nozzle 20.

Preferably, the nozzle 20 includes an upper cover 201 and a lower cover 202 detachably connected to the upper cover 201. Specifically, the lower cover 202 upwards extends to form an elastic fastener 2021. The upper cover 201 is provided with a fastening hole 2011 matched with the elastic fastener 2021. The upper cover 201 and the lower cover 202 are assembled to form a mounting cavity 23 for mounting the circuit board 21. Thus, the assembling difficulty is lowered. Preferably, the foam outlet 22 downwards tilts, which facilitates use by the user.

The key of the design of the present disclosure is as follows. The battery and the foam pump body are mainly mounted on the fixed support, and the fixed support is then mounted in the shell main body. Mounting and fixing are completed by means of the cooperation between the positioning clamping slot and the positioning clamping bulge. The novel foam pump has the advantages of simple assembling and high assembling stability. Thus, when the novel foam pump falls off, the position stability of the foam pump body and the battery can also be ensured. Meanwhile, there is a buffer space reserved between the foam pump body and the battery, so that the impact of the work of the foam pump body on the service life, the safety and other properties of the battery can also be effectively reduced.

The above descriptions are only preferred embodiments of the present disclosure, and do not limit the technical scope of the present disclosure. Therefore, any minor changes, equivalent changes and modifications made to the above embodiments according to the technical essence of the present disclosure still fall within the scope of the technical solutions of the present disclosure.

What is claimed is:

1. A novel foam pump, comprising a shell main body and a nozzle arranged on an upper side of the shell main body, wherein a battery and a foam pump body are arranged in the shell main body; the nozzle is provided with a circuit board and a foam outlet; the circuit board is electrically connected to the battery and the foam pump body; the foam pump body is provided with an input end and an output end; the input end of the foam pump body is connected with a suction pipe; the suction pipe extends out of the shell main body; the output end of the foam pump body is connected with the foam outlet; the circuit board is electrically connected with a trigger switch;

a fixed support is arranged inside the shell main body; the fixed support has an upper mounting position and a lower mounting position; the foam pump body is mounted at the upper mounting position; the battery is arranged at the lower mounting position; a circumferential surface of the fixed support is provided with a positioning clamping slot; and the shell main body is provided with a positioning clamp bulge matched with the positioning clamping slot.

2. The novel foam pump according to claim 1, wherein a first placement place is arranged on a circumferential side of the lower mounting position; a second placement place is arranged on an upper side of the upper mounting position; and a buffer space is reserved between the upper mounting position and the lower mounting position.

3. The novel foam pump according to claim 2, wherein a gap is arranged on a circumferential side wall of the upper mounting position.

4. The novel foam pump according to claim 1, wherein the trigger switch comprises a touch switch and a trigger sensor which are arranged on the circuit board; the touch switch is arranged on an upper side surface of the nozzle; the trigger sensor is arranged on a lower side surface of the nozzle; and a sensing region of the trigger sensor is correspondingly arranged below the foam outlet.

5. The novel foam pump according to claim 4, wherein the trigger sensor is an infrared sensor.

6. The novel foam pump according to claim 1, wherein a connecting cap connected with a bottle body is detachably arranged below the nozzle; and a connecting slot connected with a pourer is formed between the connecting cap and the shell main body.

7. The novel foam pump according to claim 6, wherein a pressing spacer is arranged in the connecting cap.

8. The novel foam pump according to claim 1, wherein the nozzle comprises an upper cover and a lower cover; the lower cover upwards extends to form an elastic fastener; the upper cover is provided with a fastening hole matched with the elastic fastener; and the upper cover and the lower cover are assembled to form a mounting cavity for mounting the circuit board.

* * * * *